US005604998A

United States Patent [19]

Kita

[11] Patent Number: 5,604,998

[45] Date of Patent: Feb. 25, 1997

[54] SPORTS SHOE PROVIDING HEEL STABILIZATION

[75] Inventor: Keijiro Kita, Osaka, Japan

[73] Assignee: Mizuno Corporation, Osaka-fu, Japan

[21] Appl. No.: 313,252

[22] PCT Filed: Feb. 4, 1994

[86] PCT No.: PCT/JP94/00170

§ 371 Date: Oct. 4, 1994

§ 102(e) Date: Oct. 4, 1994

[87] PCT Pub. No.: WO94/17685

PCT Pub. Date: Aug. 18, 1994

[30] Foreign Application Priority Data

Feb. 5, 1993 [JP] Japan ..... 5-008349 U
Jan. 14, 1994 [JP] Japan ..... 6-015977

[51] Int. Cl.[6] ..... A43B 23/08; A43B 19/00; A43B 7/14

[52] U.S. Cl. ..... 36/69; 36/71; 36/93

[58] Field of Search ..... 36/43, 44, 68, 36/69, 71, 93

[56] References Cited

U.S. PATENT DOCUMENTS

| | | | |
|---|---|---|---|
| 4,179,826 | 12/1979 | Davidson | 36/69 |
| 4,371,493 | 2/1983 | Minuto | 264/236 |
| 4,534,121 | 8/1985 | Autry | 36/43 X |
| 4,598,487 | 7/1986 | Misevich | 36/114 |
| 4,625,435 | 12/1986 | Ueda | 36/69 X |
| 4,642,916 | 2/1987 | Collins | 36/68 X |
| 4,706,316 | 11/1987 | Tanzi | 36/68 X |
| 4,774,776 | 10/1988 | Guilli | 36/132 |
| 4,776,109 | 10/1988 | Sacre | 36/43 X |
| 4,783,910 | 11/1988 | Boys, II et al. | 30/107 |
| 4,808,469 | 2/1989 | Hiles | 36/44 X |
| 4,821,430 | 4/1989 | Flemming et al. | 36/69 |
| 4,823,483 | 4/1989 | Chapnick | 36/43 |
| 4,878,301 | 11/1989 | Kiyosawa | 36/69 |
| 4,882,858 | 11/1989 | Signori | 36/131 |
| 4,888,225 | 12/1989 | Sandvig et al. | 36/88 X |
| 4,974,343 | 12/1990 | Davidson | 36/89 |

FOREIGN PATENT DOCUMENTS

| | | |
|---|---|---|
| 0257496 | 3/1988 | European Pat. Off. . |
| 1282517 | 1/1964 | Germany . |
| 49-8943 | 3/1974 | Japan . |
| 50-1855 | 1/1975 | Japan . |
| 61-168301 | 7/1986 | Japan . |
| 62-159601 | 7/1987 | Japan . |
| 63-116843 | 5/1988 | Japan . |
| 2-261447 | 10/1990 | Japan . |
| 04117974 | 4/1992 | Japan . |
| 4-117903 | 4/1992 | Japan . |
| 4-329901 | 11/1992 | Japan . |
| 2072487 | 10/1981 | United Kingdom . |

*Primary Examiner*—B. Dayoan
*Attorney, Agent, or Firm*—Keck, Mahin & Cate

[57] ABSTRACT

A sports shoe has an improved heel-holding capability to stabilize the heel of the foot. In a sports shoe comprising an upper member of any suitable materials and a sole of any suitable materials, a bouncing putty-containing pad is positioned on the inner surface of a reinforcing element of harder material. The reinforcing element is a cup-like stabilizer or a heel counter. The pad may comprise a foam impregnated with the bouncing putty.

7 Claims, 7 Drawing Sheets

(A)

(B)

(A)

(B)

SPORTS SHOE PROVIDING HEEL STABILIZATION

TECHNICAL FIELD

This invention relates to a sports shoe having an improved heel-holding capability to stabilize the heel of the foot.

BACKGROUND OF THE INVENTION

For purposes of preventing excessive pronation and supination of the foot occuring in walking and running, a conventional sports shoe includes a heel counter consisting of a board of synthetic resin or resin-impregnated leather and inserted between an upper and a lining at the periphery of the heel portion of the shoe, and a stabilizer having a reinforcing wall positioned on the side of the heel portion to reinforce the heel counter.

The stabilizer 19 has a particular shape for one of various shoes as shown in FIG. 12 of the accompanying drawings and, therefore, it has been found that, due to individual differences, the stabilizer fits the heel of one wearer but does not fit the heel of the other wearer. In the former case, the stabilizer can firmly and stably hold the heel of the foot during running because of stiffness of resin from which the stabilizer is formed, thereby preventing rolling of the heel. In the latter case, however, the heel of the foot is unstable in the shoe and the wearer might have a shoe sore caused by touching the stabilizer having a relatively high stiffness. The wearer might also suddenly sprain the ankle of the foot and be subject to impedimenta to the ankle, knee, waist and the like after a prolonged use of the shoe.

For purposes of fitness of the heel portion of the shoe, it has been known to employ a cup-like stabilizer shaped curvedly from a heel-treading portion toward a reinforcing wall thereof to conform to the shape of the heel. This can attain a certain degree of improvement in fitness but still makes it impossible to accommodate the individual differences so that more complete stability of the heel can not be accomplished.

Japanese patent public disclosure Sho 50-1855 and Japanese patent public disclosure Heisei 4-117903 disclose sports shoes each employing bouncing putty plastically deformed easily when a stress is applied more slowly and exhibiting a high degree of bounce under suddenly applied stresses in order to further improve the fitness of the heel portion of the shoe.

In the invention described in each of the publications, the bouncing putty is contained in a pad adhesively secured to a midsole of soft elastic material and a soft upper. With this arrangement, pressure from the heel of a wearer is liable to escape through the pad to the midsole and the upper so that the pad can not be plastically deformed enough to conform to the shape of the heel. This makes it impossible to effect full action of the bouncing putty for good fitness.

The bouncing putty itself has no self-supporting capability and a high specific gravity. Japanese patent public disclosure Heisei 4-117903 teaches mixing bouncing putty with micro-balloons in order to eliminate these disadvantages. However, the process is complicated and a significant number of micro-balloons to be mixed in the bouncing putty is required to attain a good self-supporting capability. This will lead to a high cost of the material.

SUMMARY OF THE INVENTION

An object of the invention is to provide a sports shoe having more improved fitness due to more full deformation of a bouncing putty-containing pad into the shape of the foot of a wearer and capable of fully utilizing the character of the bouncing putty in that it is easily plastically deformed when a stress is applied slowly and exhibits a high degree of bounce under suddenly applied stresses.

This object of the invention can be achieved by providing a sports shoe comprising an upper member of any suitable materials, a sole of any suitable materials, and a bouncing putty-containing pad positioned on the inner surface of a reinforcing element having a higher hardness than that of the upper member and the sole.

The reinforcing element may comprise a cup-like stabilizer including a substantially flat bottom extending from the vicinity of a treading portion to the rear end of a heel portion thereof and a reinforcing wall rising from the bottom at the periphery of the heel portion for surrounding the heel, or a heel counter interposed between the upper and a lining of the shoe, or a heel counter connected to the upper of the shoe at its heel portion. Each of the cup-like stabilizer and the heel counter may be provided with a recess having a depth of 1 to 3 mm and formed therein so as to conform to the shape of the pad, thereby positioning the pad on the reinforcing element. The pad may comprise an open-cell foam, such as urethane foam, impregnated with the bouncing putty. The pad may also comprise a bag-like sheet member enclosing the bouncing putty therein.

With the sports shoe of the invention having the bouncing putty-containing pad positioned on the inner surface of the reinforcing element, when a wearer inserts his foot into the shoe, the bouncing putty-containing pad is initially plastically deformed against the inner surface of the reinforcing element to conform to the shape of the heel of the wearer. Once plastically deformed the pad acts to exhibit the bounce when a quick impact force is applied to the pad during athletic sports. At this point, further deformation does not take place. Thus, the pad can continue to hold the heel of the wearer well during the application of the quick impact force to prevent any excessive pronation and supination of the foot.

The reinforcing element may be formed from harder materials than materials of the sole and upper and, thus, functions to bear the pressure applied to the pad without any escape.

With the recess formed in the reinforcing element in conformity with the shape of the bouncing putty-containing pad, the recess is filled with the pad under plastic deformation so that the pad can be secured to the reinforcing element without use of any adhesive.

DETAILED DESCRIPTION OF THE PREFERRED EMBODIMENTS

Figure 1:
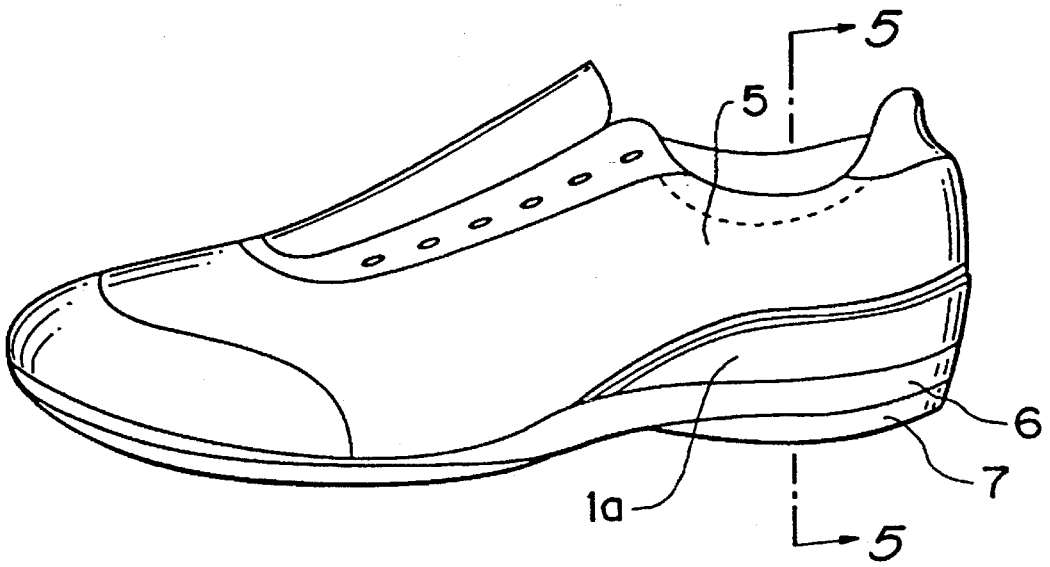
FIG. 1 is a perspective view of an embodiment of a sports shoe according to the invention.
Figure 2:
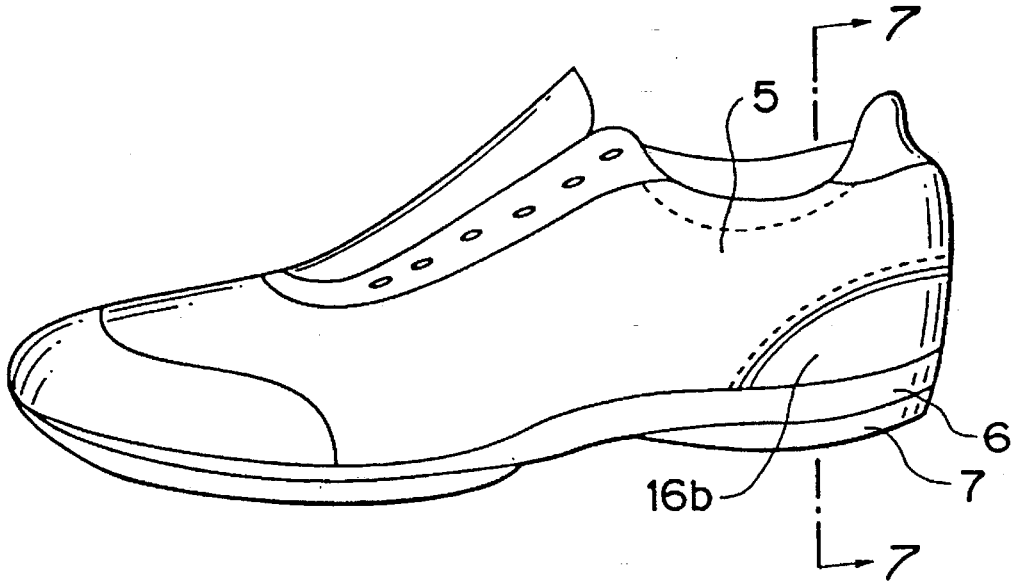
FIG. 2 is a perspective view of another embodiment of the sports shoe according to the invention.

Several embodiments of a sports shoe according to the present invention are described with reference to the drawings. As can be seen in FIGS. 1 through 8, the sports shoe according to the present invention comprises an upper member including an upper 5 and a lining 15, a sole member including a midsole 6 and an outsole 7 and a cup-like stabilizer 1*a* or 1*b*, or a heel counter 16*a* or 16*b* serving as a reinforcing element.

Figure 3:
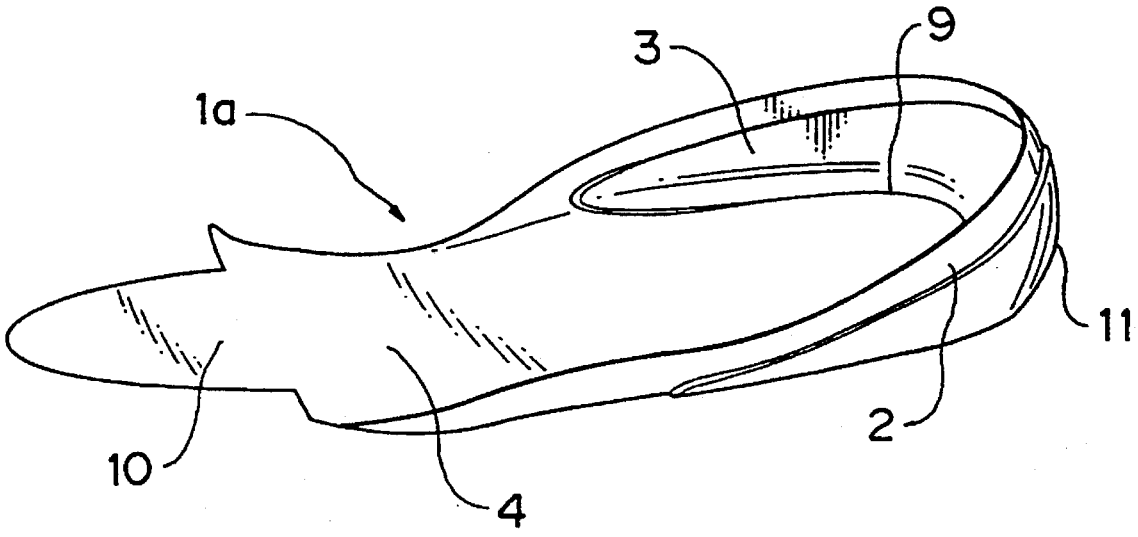
FIG. 3 is a perspective view of a cup-like stabilizer utilized in the sports shoe according to the invention.
Figure 4:
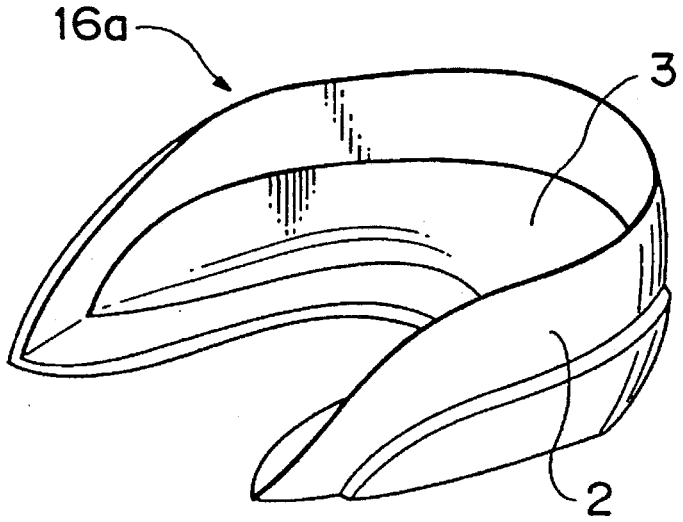
FIG. 4 is a perspective view of a heel counter utilized in the sports shoe according to the invention.
Figure 5:
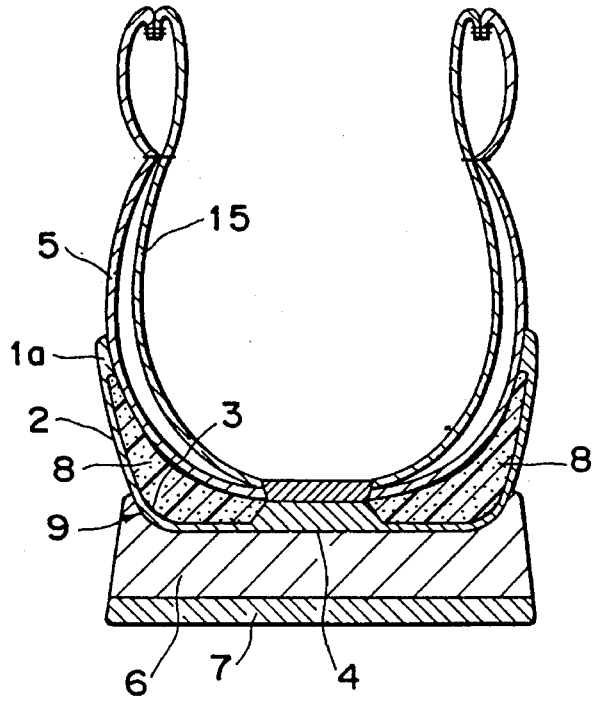
FIG. 5 is a view in cross section taken along line 5—5 of FIG. 1.

Referring now to FIG. 3, the cup-like stabilizer 1*a* which may be of hard synthetic resin includes a substantially flat bottom 4 extending from the vicinity of a treading portion 10 to the rear end of a heel portion 11 and a reinforcing peripheral wall 2 rising from the periphery 9 of the heel portion 11. As best shown in FIG. 5, the reinforcing peripheral wall is provided with a recess 3 formed in the inner surface to receive a bouncing putty-containing pad 8 therein and the recess 3 may have a depth of the degree of 1 mm.

Figure 9:
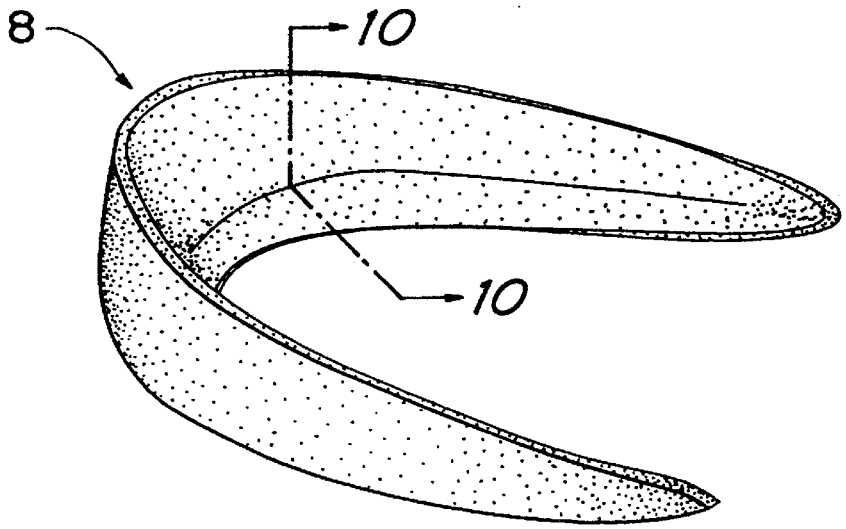
FIG. 9 is a perspective view of a pad utilized in the sports shoe according to the invention.

FIG. 9 shows the entire bouncing putty-containing pad 8. When the pad 8 is pressed into the recess 3, it is plastically deformed within the recess 3 so that the latter can be filled with the pad 8. Bouncing putty-containing pad 8 according to the invention may be of a three-dimensional horseshoe shape adapted to surround the heel of the wearer, as shown in FIG. 9.

Figure 10:
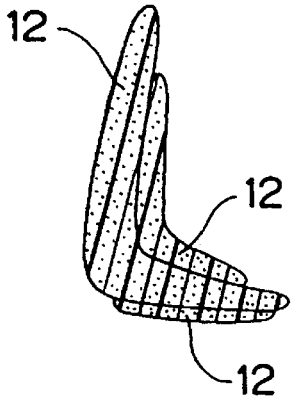
FIG. 10 is a view in cross section taken along line 10—10 of FIG. 9, but showing two embodiments (A) and (B)
Figure 10:
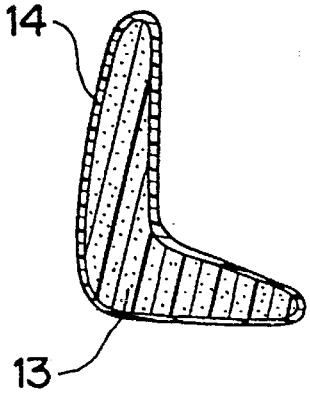

The pad 8 may be formed by stacking parts 12 of polyurethane foam impregnated with the bouncing putty and each cut into a flat horseshoe shape, and shaping the stacked parts into the three-dimensional horseshoe shape as shown in FIG. 10(A). Alternatively, the pad may be formed from a unitary block of polyurethane foam impregnated with the bouncing patty and cut into the three-dimensional horseshoe shape. A thermoforming process may also be utilized to form polyurethane foam in a mold under heat and pressure into a desired shape as described.

The bouncing putty-impregnated pad may be obtained by use of a method wherein the polyurethane foam 18 which may be open-cell foam, is first impregnated with bouncing putty 13 dissolved in a solvent and the latter is volatilized after the impregnation.

The foam may be of polyvinyl chloride, polyethylene, EVA, rubber sponge or the like other than polyurethane.

Referring to FIG. 10(B), the pad may comprise a bag-like sheet of synthetic resin 14 enclosing bouncing putty 13 therein. The bag-like sheet may be formed into a horseshoe shape or divided into a plurality of compartments each for containing the bouncing putty. Non-woven fabrics and woven fabrics can also be used as materials of the sheet.

FIG. 5 shows an embodiment of the sports shoe according to the present invention wherein the cup-like stabilizer 1*a* is adhesively secured to the sole member including the midsole 6 and the outsole 7 bonded to each other, and the pad 8 containing the bouncing putty is then pressed into the recess 3 in the peripheral wall 2 thereof. Finally, the upper member lasted in a laster is adhesively secured to the cup-like stabilizer 1*a*. If the cup-like stabilizer 1*a* is formed from transparent or translucent resin, the pad 8 can be viewed from the exterior through the stabilizer.

Figure 6:
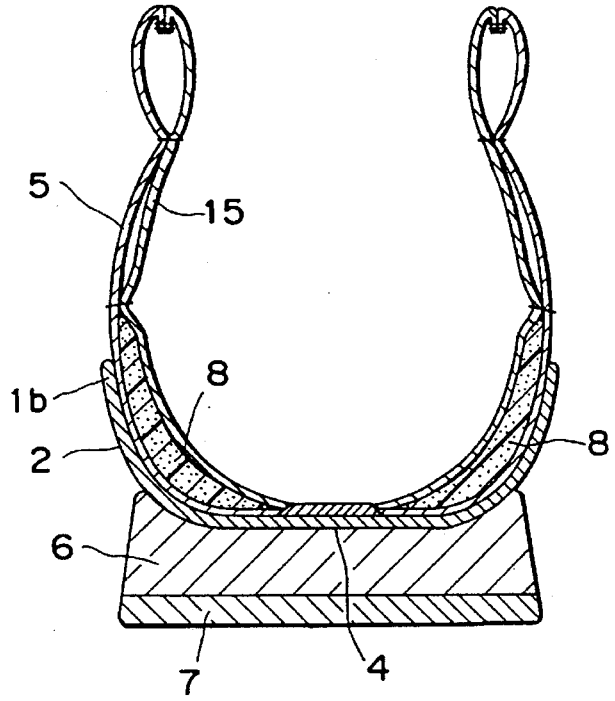
FIG. 6 is a view of another embodiment in cross section similar to FIG. 5.

FIG. 6 shows another embodiment of the sports shoe according to the invention wherein the cup-like stabilizer 1*b* which may also be of hard synthetic resin has a shape substantially similar to that of the stabilizer 1*a* but there is no recess formed in the stabilizer. During stitching operation of the upper member, the bouncing putty-containing pad 8 is interposed between the upper 5 and the lining 15 of the sports shoe. The stabilizer 1*b* is adhesively secured to the sole member including the midsole 6 and the outsole 7 bonded to each other and the upper member having the pad 8 interposed between the upper 5 and the lining 15 as described above, is adhesively secured to the stabilizer 1*b*.

Figure 7:
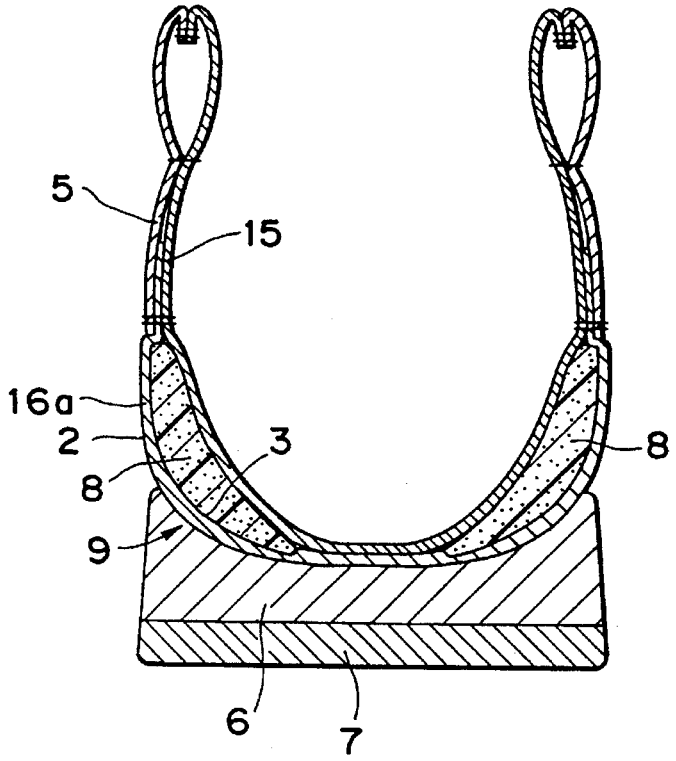
FIG. 7 is a view in cross section taken along line 7—7 of FIG. 2.

FIG. 7 shows a further embodiment of the sports shoe according to the invention wherein the heel counter 16*a* is used as a reinforcing element of the sports shoe. The heel counter 16*a* comprises reinforcing peripheral wall 2 rising from the bottom on the upper surface of the midsole 6 and shaped to surround the heel of the wearer. The peripheral wall 2 is provided with the recess 3 in which the bouncing putty-containing pad 8 is received. Heel counter 16*a* is connected to the upper 5 of the upper member at its heel region and the bouncing putty-containing pad 8 is interposed between the heel counter 16*a* and the lining 15 while being pressed into the recess 3.

In making the sports shoe of this embodiment, the upper member with the heel counter 16*a* stitched thereto and the pad 8 inserted between the heel counter and the lining, is lasted and secured to the sole member including the midsole 6 and the outsole 7 bonded to each other, with the heel counter 16*a* adhesively secured to the midsole 6.

The heel counter 16*a* may be made of the same hard synthetic resin as that of the cup-like stabilizer as described. Use of transparent or translucent resin makes it possible to view the pad from the exterior of the sports shoe.

Figure 8:
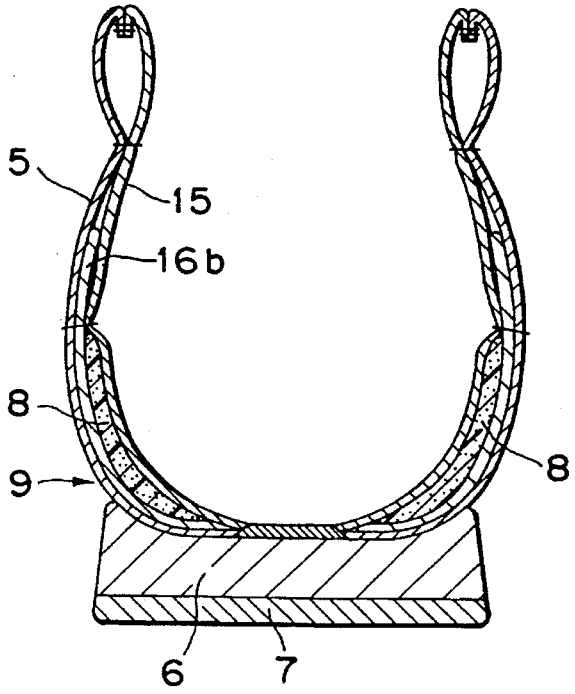
FIG. 8 is a view of another embodiment in cross section similar to FIG. 7.

FIG. 8 shows a still further embodiment of the sports shoe wherein the heel counter 16*b* is used as reinforcing element. The heel counter 16*b* is inserted between the upper 5 and the lining 15 and stitched to them together. The bouncing putty-containing pad is inserted between the inner surface of the heel counter 16*b* and lining 15.

In making the sports shoe of this embodiment, the upper member with the heel counter 16*b* and the pad 8 inserted therein, is lasted and adhesively secured to the sole member including the midsole 6 and the outsole 7 bonded to each other.

Heel counter 16*b* may be of the same hard synthetic resin as that of the cup-like stabilizer as described.

Hard synthetic resin of which each of the cup-like stabilizer 1*a* and 1*b* and the heel counter 16*a* and 16*b* is made, may comprise nylon, polyurethane, polystyrene, or the like having 60 to 70 degrees, preferably, 63 degrees, in (JIS K 7125) D hardness.

In order to enhance the elasticity and self-supporting capability of the reinforcing elements, they may be reinforced with glass fibers, carbon fibers, super-elastic metal or the like.

The bouncing putty in the pad 8 is easily plastically deformed when a stress is applied more slowly and exhibits high elasticity or bounce under impact stresses. The bouncing putty 13 may be of silicone elastomer or urethane elastomer.

Figure 11:
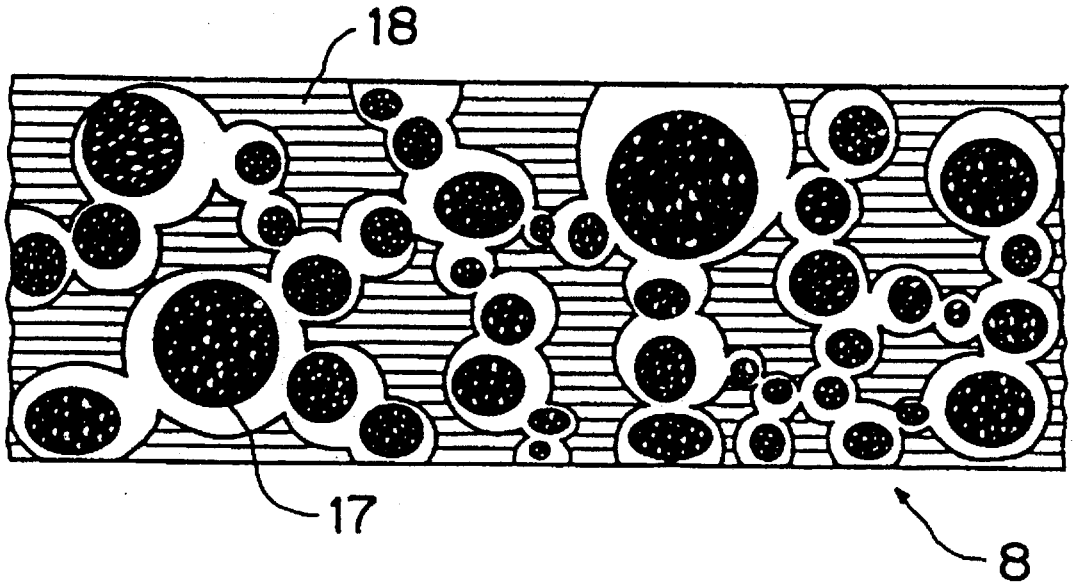
FIG. 11 is a view showing behaviors of a foam impregnated with bouncing putty, (A) showing the foam before compression and (B) showing the foam after compression.
Figure 11:
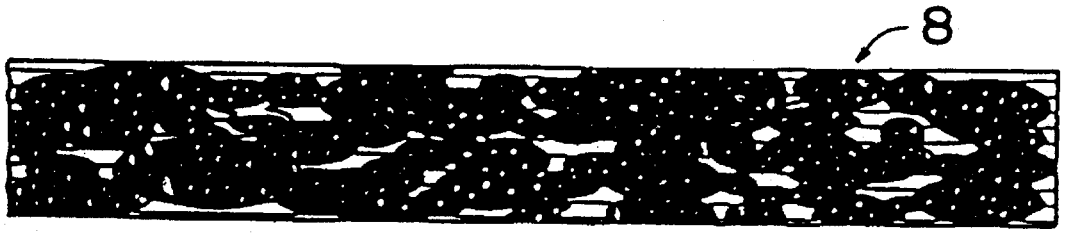
Figure 12:
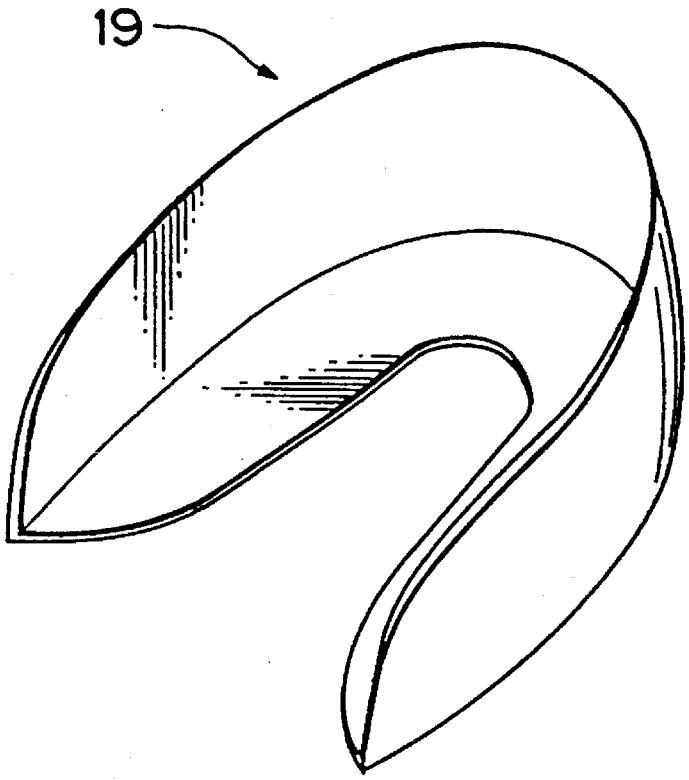
FIG. 12 (PRIOR ART)
FIG. 12 is a perspective view of a conventional stabilizer.

Referring to FIG. 11, there is shown a pad 8 comprising open-cell foam 18 impregnated with bouncing putty. When the wearer inserts his foot into the sports shoe constructed in accordance with the present invention, the pad 8 is initially compressed by the heel of the wearer to conform to the shape of the heel. Thus, the dispersed bouncing putty particles 17 in the open-cell foam 18 agglomerate due to its compression. Upon completion of the plastic deformation of the pad 8 under the heel pressure, it will have the same behavior as that of the bouncing putty itself. The plastically deformed pad 8 acts to exhibit bounce under the impact force applied thereto during athletic sports.

Although in the embodiments as described, the bouncing putty-containing pads 8 have been formed into the three-dimensional horseshoe shape, the invention is not limited to this shape and the pads may be of the form of a sheet or hemispherical shape.

The sports shoe constructed in accordance with the present invention has advantages as described below.

Firstly, since the reinforcing element is made of material such as hard synthetic resin or super-elastic metal having appropriate stiffness, it can firmly support the heel and the arch of the foot. By positioning the bouncing putty-containing pad, inside the reinforcing element, the pressure from the foot is fully applied to the pad without escaping to the upper and the relatively soft midsole to ensure that the pad can be plastically deformed to conform to the shape of the heel of the foot.

The plastically deformed pad exhibits the bounce under the impact force suddenly applied from the ground in use due to the character of the bouncing putty and can continue to hold the heel of the foot, thereby preventing the excessive pronation and supination of the foot.

The use of the open-cell foam such as urethane foam, impregnated with bouncing putty, provides a self-supporting capability to the bouncing putty and, in addition, results in significant reduction in a weight of the pad and hence, of the sports shoe.

The recess of the degree of 1mm to 3mm in depth is formed in the reinforcing element in conformity with the shape of the pad. Since the pad is secured to the reinforcing element by pressing the pad into the recess, there is no need for application of adhesive in the shoe making process.

What is claimed is:

1. A sports shoe comprising:

an upper member, a sole, a reinforcing element connected to at least one of the upper member and the sole, and a bouncing putty-containing pad positioned on an inner surface of said reinforcing element for holding and stabilizing a heel of a wearer, wherein said pad comprises an open-cell foam impregnated with the bouncing putty.

2. The sports shoe according to claim 1 wherein said reinforcing element comprises a stabilizer which is curved upwardly to conform to a shape of the heel of the wearer.

3. The sports shoe according to claim 2 wherein said stabilizer has a recess formed therein to position the pad.

4. The sports shoe according to claim 1, and further comprising a lining of the shoe received within said upper member, wherein said reinforcing element comprises a heel counter interposed between the upper member and said lining of the shoe.

5. The sports shoe according to claim 1 wherein said reinforcing element comprises a heel counter connected to the upper member at a heel region of the shoe.

6. The sports shoe according to claim 4 wherein said heel counter has a recess formed therein to position said pad.

7. The sports shoe according to claim 1 wherein said pad comprises a sheet member formed as a bag and enclosing the bouncing putty therein.

* * * * *